United States Patent [19]

Kohzai

[11] 4,080,547

[45] Mar. 21, 1978

[54] COLOR PICKUP TUBES CONTAINING STRIPE FILTERS

[75] Inventor: Hayao Kohzai, Mobara, Japan

[73] Assignee: Hitachi, Ltd., Tokyo, Japan

[21] Appl. No.: 660,017

[22] Filed: Feb. 23, 1976

Related U.S. Application Data

[63] Continuation of Ser. No. 494,740, Aug. 5, 1974, abandoned.

[30] Foreign Application Priority Data

Oct. 15, 1973 Japan ..... 48-114775

[51] Int. Cl.[2] ..... H01J 29/10; H01J 31/46

[52] U.S. Cl. ..... 313/371; 358/46

[58] Field of Search ..... 313/371, 386; 358/55

[56] References Cited

U.S. PATENT DOCUMENTS

| | | | |
|---|---|---|---|
| 2,871,371 | 1/1959 | Gray | 313/371 |
| 2,917,574 | 11/1959 | Toulon | 313/371 |
| 3,588,224 | 6/1971 | Pritchard | 358/55 |
| 3,772,552 | 11/1973 | Kubota | 313/371 |
| 3,857,037 | 12/1974 | Tomii et al. | 313/371 |

OTHER PUBLICATIONS

White, Modern College Physics, Van Nostrand Co., New York; Jan. '56; p. 469 cited.

*Primary Examiner*—Robert Segal
*Attorney, Agent, or Firm*—Charles E. Pfund

[57] ABSTRACT

The optical system of a pickup tube is comprised by an optical low pass filter, a light transmissive substrate formed with a black mask and a color compensating filter, and another light transmissive substrate formed with a photoconductive film at a predetermined position of one surface, which are bonded together into an integral structure. The optical system is mounted on the light receiving end of the pickup tube. When compared with a conventional construction wherein the component elements of the optical system are independently and separately mounted the loss of the incident light due to reflections at the interfaces of respective elements can be reduced.

1 Claim, 7 Drawing Figures

COLOR PICKUP TUBES CONTAINING STRIPE FILTERS

This is a continuation of application Ser. No. 494,740 filed Aug. 5, 1974 now abandoned.

BACKGROUND OF THE INVENTION

This invention relates to a colour pickup tube containing a stripe type filter, and more particularly to an optical system utilized in the light receiving portion of such a pickup tube.

As is well known in the art, the optical system utilized in the light receiving portion at one end of such pickup tube, that is a single tube type colour pickup tube is constructed as follows. Thus, it generally includes an optical low pass filter, a colour compensating filter, a black mask, a stripe filter, a transparent electroconductive film, and a photoconductive film which are disposed in the order mentioned in a direction from an object toward the tube, and incorporated into the light receiving end of the tube. The term "optical low pass filter" is used herein to mean a filter which eliminates the high frequency components of the spatial frequencies of light, and typically comprises a quartz lens utilizing a double refraction phenomenon or a lenticular lens. The purpose of this filter is to prevent erroneous colouring of the picked up image. Such filter is effective to prevent erroneous colouring of the picked up image which occurs when the pitch of the high frequency components of the spatial frequencies of the light emanated by the object corresponds to the inherent pitch of the stripe filter. However, such filter is optically directive so that it is necessary to align the directivities of the filter and stripe filter when assembling them.

Various component elements described above of the optical system provided for the light receiving end of a pickup tube have been separately mounted on the light receiving end of the tube. However, as such method of independently and separately mounting the component elements is not advantageous from the standpoint of the characteristics and fabrication of the pickup tube, various improvements have been proposed. But even with such improvements, the following problems have not yet been solved. More particularly, since various component elements are separately and independently mounted, the optical interfaces of respective component elements act independently upon the incident light to the pickup tube with the result that the incident light is subjected to such optical actions as reflection, refraction and so forth at the interfaces of respective component elements.

Considering reflection for example, the incident light is reflected two times, one occurring at the time of incidence to an element, and the other at the time of issuing from the element. The loss of the incident light quantity caused by such reflections of course deteriorates the sensitivity and picture quality of the pickup tube. From the standpoint of fabrication, the method of independently and separately mounting respective component elements requires independent supports for respective elements which make it difficult to miniaturize the construction of the tube and to decrease the number of steps of fabrication and hence the cost of the tube. Further, the method of independent and separate mounting makes it possible to properly adjust the optical system. For example, where the optical low pass filter is made of quartz considerable difficulty is encountered for mounting the low pass filter with the crystal axis of the qualtz oriented at a predetermined angle with respect to the direction of the stripe filter. Further, it is also difficult to make parallel respective elements. Although such difficulties can be avoided by precisely designing and machining of the supports for the component element such measure increases the cost of manufacturing. Increases in the time and labour for mounting and adjustment increase not only the cost but also the chance of contaminating the photoconductive film due to deposition of dust or other foreign substances thus degrading the characteristic of the resulting tube. Thus, the prior method of independently manufacturing, storing, conveying, assembling and adjusting various component elements of the optical system increases the chance of contamination and damage of the optical surfaces of the elements, so that it is difficult to expect satisfactory results.

SUMMARY OF THE INVENTION

Accordingly, it is an object of this invention to provide an improved colour pickup tube containing a stripe filter wherein the number of the optical interfaces to the incident light is substantially decreased whereby the loss of the incident light caused by the reflection at the interfaces in reduced and thereby improving the sensitivity and picture quality of the tube.

According to this invention, this object can be accomplished by constructing various elements constituting the optical system to be mounted on the light receiving portion of a colour pickup tube containing a stripe filter, that is an optical low pass filter, a colour compensating filter, a black mask, stripe filter, a transparent electroconductive film, and a photoconductive film as an internal structure which are substantially continuous with respect to the light passing therethrough. More particularly, a first light transmissive substrate formed with an optical low pass filter, a black mask and a colour compensating filter of prescribed configurations at predetermined positions and a second light transmissive substrate formed with a lamination of a stripe filter, a transparent electroconductive film and a photoconductive film on one surface thereof are bonded together into an integral structure by means of a resinous binder having substantially the same reflective index as the first and second light transmissive substrates, thus substantially eliminating the optical interfaces of respective component elements of the optical system with the result that the loss of the incident light caused by the reflections at the interfaces is reduced and the sensitivity and the picture quality can be improved.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
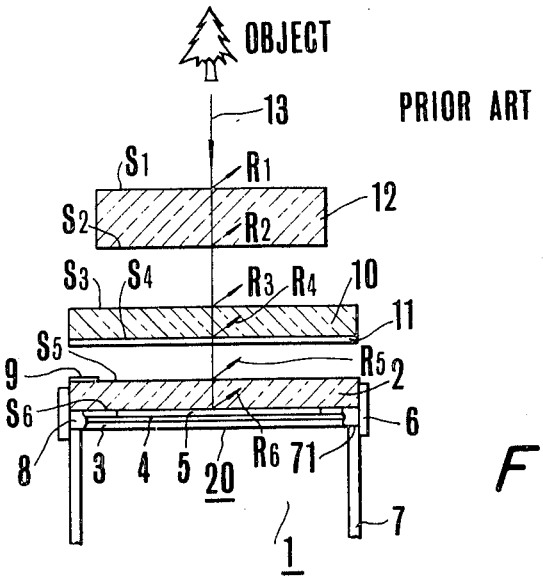
FIG. 1 is a diagrammatic longitudinal sectional view showing the construction of the optical system at the light receiving portion of a prior art colour pickup tube containing a stripe filter.

Referring now to the accompanying drawings, FIG. 1 shows the construction of the optical system at the light receiving portion of a prior art colour pickup tube containing a stripe filter. As shown, the optical system comprises an optical low pass filter 12 (hereinafter, termed as a qualtz plate), a light transmissive substrate 10 made of glass for example, and formed with a colour compensating filter 11 deposited thereon, and a light transmissive substrate 2 including a black level stabilizing black mask 9 having a predetermined configuration and deposited on a selected portion of one surface and a photoelectric converting member comprising a stripe filter 5, a transparent electroconductive film 4 and a photoconductive film 3 which have predetermined configurations and are laminated on a selected portion of the opposite surface (hereinafter, the substrate 2 including elements 3, 4, 5 and 9 is designated as a face plate 20), said elements 12, 10 and 20 being positioned in the order mentioned in the direction of the incident light 13 from an object. The quartz plate 12 and the light transmissive substrate 10 are mounted on the light receiving end of the pickup tube by means of suitable supports, not shown. The face plate 20 is secured to the end 71 of glass tube 7 comprising the pickup tube by means of a suitable electroconductive sealing agent 8 for example indium, said end 71 confronting the object. An electrode 6 for deriving out signals and for holding the face plate 20 in position is provided to surround the face plate 20 and the sealing agent 8.

In the optical system constructed as described above, the space defined between the quartz plate 12 and the glass substrate 10 and that between the colour compensating filter 11 and the face plate 20 do not play any important role for providing desired characteristic to the optical system, but are formed as the result of the design of the optical system. Rather, the presence of such spaces causes the incident light 13 to be subjected to the optical actions of the inherent optical surfaces $S_1$, $S_2$; $S_3$, $S_4$ and $S_5$, $S_6$ of the respective component elements. Arrows $R_1$ through $R_6$ shown in FIG. 1 show reflections of the incident ray at the optical interfaces of respective elements. It will be clear that the loss of the incident light caused by such multiple reflections is substantial. Assuming 100 parts of the incident light, the quantity of light passing through the interface $S_6$ of the face plate 20 generally reduces to about from 90 to 95%, such loss of light reducing the sensitivity of the pickup tube.

In addition to various defects described above, in the optical system shown in FIG. 1, the manufacture of the face plate 20 involves various problems, one of which being caused by the step of forming the black mask 9 and the photoconductive film 3. Thus, the characteristic of the photoconductive film 3 generally made of antimony trisulfide, selenium or lead oxide is greatly affected by the contamination caused by dust or other foreign substances contained in air. For this reason, deposition of the photoconductive film should preferably be made in a pure environment at the final stage of manufacturing the face plate 20. In other words, the steps of manufacturing the face plate 20 should follow the order of forming the black mask and then forming the photoconductive film. Further, after forming the black mask it is necessary to clean the face plate before forming the photoconductive film. Cleaning is generally performed by an ultrasonic treatment in deionized water at a suitable temperature. Since the black mask is often peeled off by this treatment it is necessary to test the bonding strength of the black mask after this treatment.

Further, where respective component elements of the optical system are mounted independently and separately as shown in FIG. 1, the adjustment of the optical system as a whole is extremely difficult as in the case of orienting the crystal axis of the quartz plate 12 at a desired angle with respect to the stripe filter. As has been pointed out before, it is difficult to design and manufacture supports for such independently and separately mounted component elements.

Figure 2:
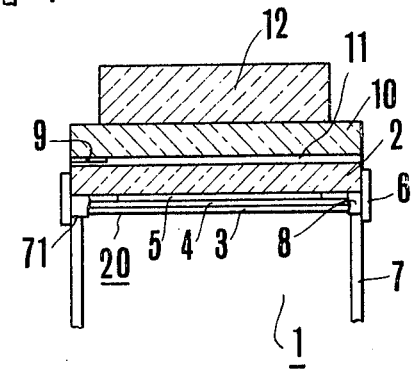
FIG. 2 shows a longitudinal section of one embodiment of an optical system embodying the invention.
Figure 5A:
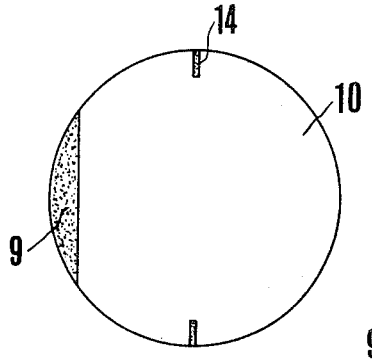
FIGS. 5*a*, 5*b* and 5*c* show a plan view and sectional views illustrating one example of the method of fabricating the optical system embodying the invention.
Figure 5B:
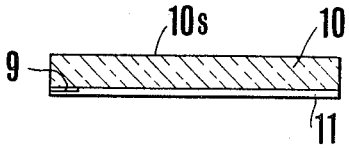
Figure 5C:
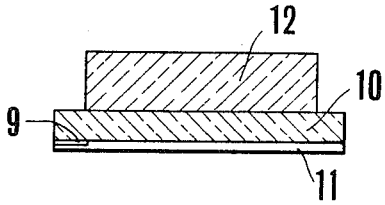

The invention contemplates the provision of efficient means for solving these difficulties. FIG. 2 illustrates one embodiment of this invention wherein elements corresponding to those shown in FIG. 1 are designated by the same reference numerals. The embodiment shown in FIG. 2 is fabricated by the sequential steps shown in FIGS. 5*a*, 5*b* and 5*c*. After subjecting glass substrate 10 to a prescribed pretreatment, a chromium filter is formed by vapour deposition in a selected area on one surface of the substrate, thus forming the black level stabilizing black mask 9. Concurrently therewith, marker lines 14 having a width of about 0.1 mm are deposited on diametrically opposite portions of the substrate 10 as shown in FIG. 5*a*. These marker lines are used as reference lines for adjusting the relative position of the quartz plate 12 and the stripe filter 5 interposed between the substrate 2 of the face plate 20 and the photoconductive film 3 when assembling the embodiment shown in FIG. 2. Thereafter, a colour compensating filter 11 is applied to cover the entire surface of the substrate 10 as well as the black mask 9 on the same surface as the surface on which the black mask has been applied, as shown in FIG. 5*b*. Alternatively, it is also possible to first form the filter 11 and then apply the black mask 9 thereon. When forming the colour compensating filter 11 it is necessary to correlate the material of the colour compensating film 11 with that forming the photoconductive film 3, as is well known in the art. Thus for example, where the photoconductive film 3 comprises a vapour deposited film of antimony trisulfide it is necessary to construct the filter such that it intercepts the light in near infrared region because antimony trisulfide is sensitive to the light in this region. Where the photoconductive film comprises a vapour deposited film or selenium or lead oxide it is necessary to construct the filter such that it intercepts light in the ultraviolet region. In the selected area on the substrate 2, stripe filter 5, transparent conductive film 4 and photoconductive film 3 are sequentially formed in the order mentioned to form the face plate 20. Then, the quartz plate 12 and the free surface 10*s* (FIG. 5*b*) of the substrate 10, that is the surface thereof on which the black mask 9 and the colour compensating filter 11 have not been formed, are bonded together with a binder having substantially the same refractive index as the glass of the substrate 10, as shown in FIG. 5*c*. Similarly, then the surface of the substrate 10 on which the black mask 9 and filter 11 have been applied and the surface of the face plate 20 opposite to the surface on which the photoconductive film has been applied are bonded together at a suitable relative position by referring to the marker lines 14 to form an integral optical system as shown in FIG. 2 which is substantially continuous for light. The binder utilized to bond together substrates 2 and 10 consists of a light transmissive material having substantially the same refractive index and is photochemically stable. It was found that epoxy resin gives satisfactory results. It was also found that according to this integral structure, it was possible to increase the quantity of the transmitting light by 4 to 5% per interface when compared with a prior art optical system wherein various elements are independently and separately mounted. So long as the conditions described above can be satisfied any type of binder can be used. Of course, binders which affect the characteristics of the coated mask, filter and photoconductive film should not be used. For example, resins requiring extremely high curing temperatures should not be used because the characteristic of the transparent conductive film is apt to be deteriorated in the high temperature range.

According to the optical system described above which is to be mounted on the light receiving portion of a pickup tube, the interfaces $S_2$, $S_3$, $S_4$ and $S_5$ among various interfaces shown in FIG. 1 are substantially eliminated so that it is possible to increase the effective quantity of the light impinging upon the pickup tube. Since the spaces of no use between the elements have been eliminated, the axial space occupied by the optical system can be reduced greatly when compared with the prior art construction. Accordingly, it is possible to hold the optical system only at the end 71 of the tube 7 thus simplifying the design of the optical system, reducing the number of the supports as well as the number of fabrication steps and reducing the time required to adjust the elements at the time of fabrication.

Figure 3:
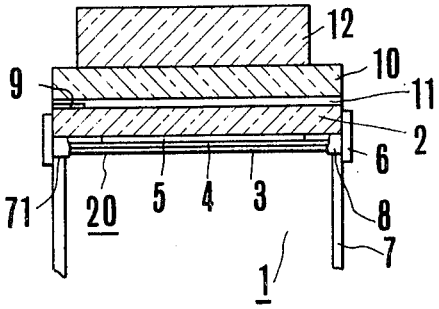
FIG. 3 shows a longitudinal section of a modified optical system.
Figure 4:
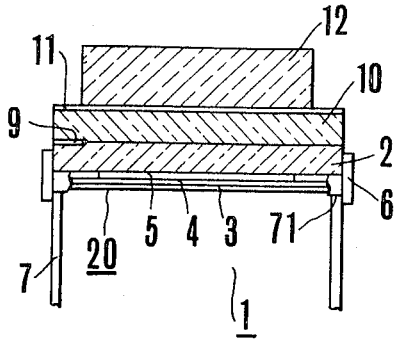
FIG. 4 shows a longitudinal section of another modification of the optical system.

FIGS. 3 and 4 illustrate other embodiments of this invention wherein the relative position between the colour compensating filter 11 and black mask 9 is varied. In the case of FIG. 3, the colour compensating filter 11 and the black mask 9 are formed on the same side of the substrate 10 whereas in the case of FIG. 4, they are formed on the opposite sides. These embodiments are characterized in that the black mask is not formed on the same substrate as the photoelectric connecting member comprising the stripe filter 5, the transparent conductive film 4 and the photoconductive film 3. With this construction, it is not necessary to wash the black mask 9 and since the photoconductive film 3 is formed by an appropriate independent step it is possible to prevent it from contamination caused by foreign substances, thus simplifying the fabrication of the optical system for use in pickup tubes. In these embodiments, it is also possible to greatly decrease the loss of light due to reflection.

As described hereinabove, the invention provides a compact optical system of an integral structure for use in a colour pickup tube containing a stripe filter, which can substantially eliminate or decrease the number of optical interfaces of various component elements of the optical system. Accordingly, it is possible to prevent reflection of the incident light at respective interfaces which is effective to increase the effective light incident to the pickup tube thus improving the sensitivity and picture quality thereof.

Such integral construction of the optical system also decreases the number of supports for respective elements, prevents deterioration of the characteristic of the photoconductive film due to contamination and simplifies the fabrication steps due to elimination of the washing step.

What is claimed is:

1. In a colour pickup tube containing a stripe filter and of the type comprising an optical system mounted on the light receiving portion of said tube and including a photoelectric converting member for converting light from an object into an electric signal; an electron gun assembly, and an envelope containing said electron gun assembly in one end thereof, the opposite end of said envelope being sealed with a first light transmissive substrate, the inner surface of said substrate being provided with respectively with said stripe filter, a transparent conductive film and said photoelectric converting member, and sealed within said envelope, said optical system being mounted to the outer surface of said first light transmissive substrate, the improvement wherein said optical system provides a continuous axial path without refractive surface discontinuity and comprises an outer plate which is an optical low pass filter, a second light transmissive substrate having a color compensating filter on one surface, said one surface bonded to a surface of said plate, said second light transmissive substrate having the other surface including a black level stablizing black mask thereon bonded to the outer surface of said first light transmissive substrate, each bonded interface being provided with means bonding said substrates with material having substantially the same refractive index which is photochemically stable.

* * * * *

UNITED STATES PATENT AND TRADEMARK OFFICE

CERTIFICATE OF CORRECTION

PATENT NO. : 4,080,547

DATED : March 21, 1978

INVENTOR(S) : Hayao Kohzai

It is certified that error appears in the above-identified patent and that said Letters Patent are hereby corrected as shown below:

Column 1, line 61, "make" should be ---makes---;
line 65, "possible" should be ---difficult---.

Column 2, line 1, "qualtz" should be ---quartz---;

line 26, "and" should be deleted.

Column 3, line 12, "qualtz" should be ---quartz---.

Column 6, Claim 1, line 31, "with", first occurrence, should be deleted.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*